US006851244B2

(12) United States Patent
Vilhauer

(10) Patent No.: US 6,851,244 B2
(45) Date of Patent: Feb. 8, 2005

(54) CORNER KEY DOOR ASSEMBLY

(75) Inventor: Kevin Vilhauer, Graham, WA (US)

(73) Assignee: Masco Corporation, Taylor, MI (US)

( * ) Notice: Subject to any disclaimer, the term of this patent is extended or adjusted under 35 U.S.C. 154(b) by 0 days.

(21) Appl. No.: 10/340,981

(22) Filed: Jan. 13, 2003

(65) Prior Publication Data

US 2004/0134153 A1 Jul. 15, 2004

(51) Int. Cl.[7] ..... E06B 1/04

(52) U.S. Cl. ..... 52/656.9; 52/656.5; 52/656.4; 52/656.2

(58) Field of Search ..... 52/656.2, 656.4, 52/656.5, 656.7, 656.9, 204.67, 204.7, 204.705, 204.71, 204.72

(56) References Cited

U.S. PATENT DOCUMENTS

| | | | | | |
|---|---|---|---|---|---|
| 3,845,604 | A | * | 11/1974 | Ottosson | 52/758 |
| 4,250,680 | A | * | 2/1981 | Bomar | 52/656 |
| 4,286,716 | A | | 9/1981 | Budich et al. | |
| 4,555,868 | A | | 12/1985 | Mancuso | |
| 4,556,337 | A | * | 12/1985 | Marshall | 403/255 |
| 4,624,091 | A | | 11/1986 | Biro | |
| 4,640,061 | A | | 2/1987 | Trumley | |
| 4,640,078 | A | | 2/1987 | Haffer | |
| 4,689,933 | A | | 9/1987 | Biro | |
| 4,831,804 | A | | 5/1989 | Sayer | |
| 4,875,271 | A | * | 10/1989 | Coller et al. | 29/432 |
| 4,944,118 | A | | 7/1990 | Biro | |
| 5,363,611 | A | | 11/1994 | Richardson et al. | |
| 5,544,454 | A | | 8/1996 | Richardson et al. | |
| 5,647,172 | A | | 7/1997 | Rokicki | |
| 5,657,591 | A | | 8/1997 | Kitada | |
| 5,657,604 | A | * | 8/1997 | Malott | 52/655.1 |
| 5,761,860 | A | * | 6/1998 | Koike et al. | 52/204.67 |
| 5,910,083 | A | | 6/1999 | Richardson et al. | |
| 5,921,051 | A | | 7/1999 | Hope | |
| 6,006,478 | A | * | 12/1999 | Hubner et al. | 52/204.5 |
| 6,442,805 | B2 | * | 9/2002 | Pfister | 24/514 |
| 2002/0023391 | A1 | * | 2/2002 | Nymark | 52/36.4 |

* cited by examiner

*Primary Examiner*—Brian E. Glessner
(74) *Attorney, Agent, or Firm*—Carlson, Gaskey & Olds, PC

(57) ABSTRACT

A closure assembly is provided that includes first and second intersecting members such as a rail and stile. The rail and stile are engaged with one another forming a butt joint, preferably a corner. Male and female keys are respectively secured to the rail and stile with the keys forming a dovetail interlocking relationship with complimentary tapered surfaces. A fastener is received by the keys to expand the tapered surfaces forcing the rail and stile to be drawn into further engagement with one another at the butt joint. The interlocking tapered surfaces produce a stronger joint and eliminate any gap that might result at the joint as the threaded fastener is installed. The door is assembled by securing the male key to the rail. The stile is aligned with the rail and the second key is inserted into a pocket in the stile. The male and female keys are interlocked and a fastening element is installed into the keys to expand the keys and draw the rail and stile into further engagement with one another.

14 Claims, 3 Drawing Sheets

CORNER KEY DOOR ASSEMBLY

BACKGROUND OF THE INVENTION

This invention relates to a device for securing two structural members of a closure assembly, more particularly, the invention relates to a device for more securely connecting two intersecting members of a door such as a rail and stile.

Closure assemblies such as doors and windows typically are constructed of numerous structural members that may be secured to one another at their intersection. Increasingly, hollow vinyl or fiberglass members are used to form the structural components of the closure assemblies. This presents difficulties in obtaining a secured joint at the intersection of the members. However, this is of much less of a concern for windows because of the much lower stresses at the joints as compared to doors.

It is desirable to provide a hollow fiberglass door with the look of solid wood. Many prior art devices used to connect intersecting members of doors employ one or more angle brackets. The angle brackets permit the door to deflect considerably since they are typically thin, L-shaped metal members. Furthermore, there is no mechanism with the prior art brackets to draw the intersecting members into further engagement with one another as the members are being secured to one another. As a result, there may be a visible gap at the joint requiring a lip to overlap the joint to hide the gap. The resultant door does not have a planar surface similar to that of a door constructed from solid wood members. Therefore, what is needed is an improved device to better secure the structural intersecting members of a door while enabling a planar wood surface to be provided.

SUMMARY OF THE INVENTION AND ADVANTAGES

The present invention provides a closure assembly including first and second intersecting members such as a rail and stile. The rail and stile are engaged with one another forming a butt joint, preferably a corner. Male and female keys are respectively secured to the rail and stile with the keys forming a dovetail interlocking relationship with complimentary tapered surfaces. A fastener is received by the keys to expand the tapered surfaces forcing the rail and stile to be drawn into further engagement with one another at the butt joint. The interlocking tapered surfaces produce a stronger joint and eliminate any gap that might result at the joint as the threaded fastener is installed. The door is assembled by securing the male key to the rail. The stile is aligned with the rail and the second key is inserted into a pocket in the stile. The male and female keys are interlocked and a fastening element is installed into the keys to expand the keys and draw the rail and stile into further engagement with one another.

Accordingly, the above invention provides an improved device to better secure the structural intersecting members of a door while creating a planar surface.

BRIEF DESCRIPTION OF THE DRAWINGS

Other advantages of the present invention can be understood by reference to the following detailed description when considered in connection with the accompanying drawings wherein.

DETAILED DESCRIPTION OF THE PREFERRED EMBODIMENT

Figure 1:
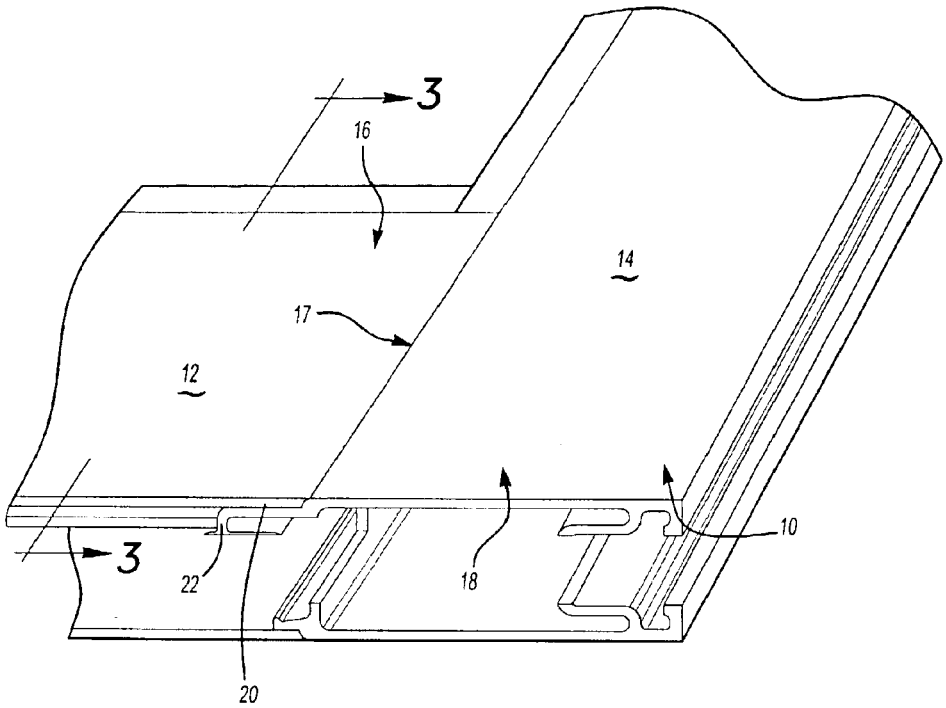
FIG. 1 is a perspective view of a corner of a door.

A closure assembly 10 such as a door is shown in the Figures. The door 10 includes a horizontal rail 12 intersecting a stile 14. Where the rails 12 and stiles 14 form a corner, a robust device is needed to secure the members tightly to one another while enabling an aesthetically pleasing appearance to be achieved. This is particularly true where hollow fiberglass members are used, such as with the present invention. This is even more the case when a wood laminate is used on the exterior of the fiberglass members to simulate a solid wood door in which a planar wood surface is desired. The rail 12 and stile 14 respectively include first 16 and second 18 faces that form a generally continuous planar surface similar to that of a solid wood door. In order to achieve an aesthetically pleasing appearance, the faces 16 and 18 must meet flush at seam 17, which requires the rail 12 and stile 14 to be drawn into tight engagement with one another during the assembly of the corner.

Figure 2A:
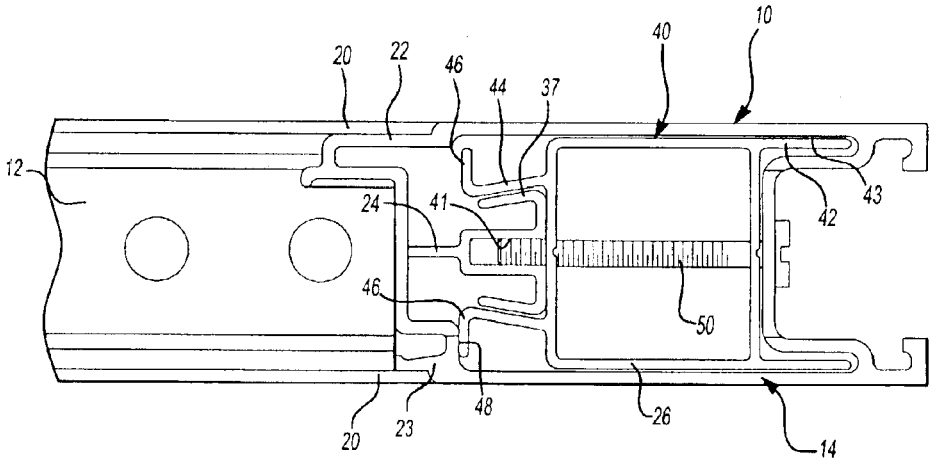
FIG. 2A is an end view of the door shown in FIG. 1 depicting the corner keys.
Figure 2B:
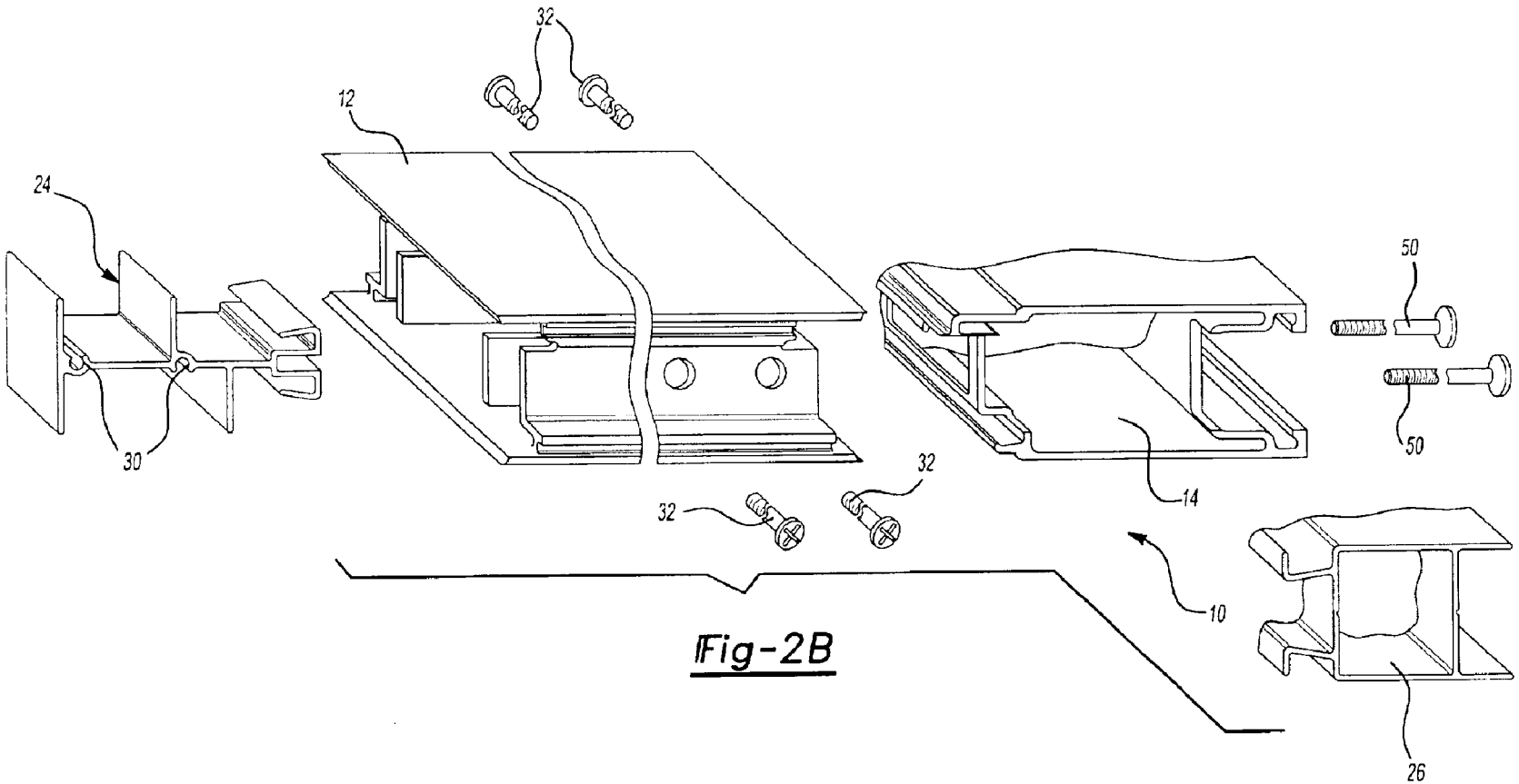
FIG. 2B is an exploded perspective view of the assembly shown in FIG. 2A.
Figure 3:
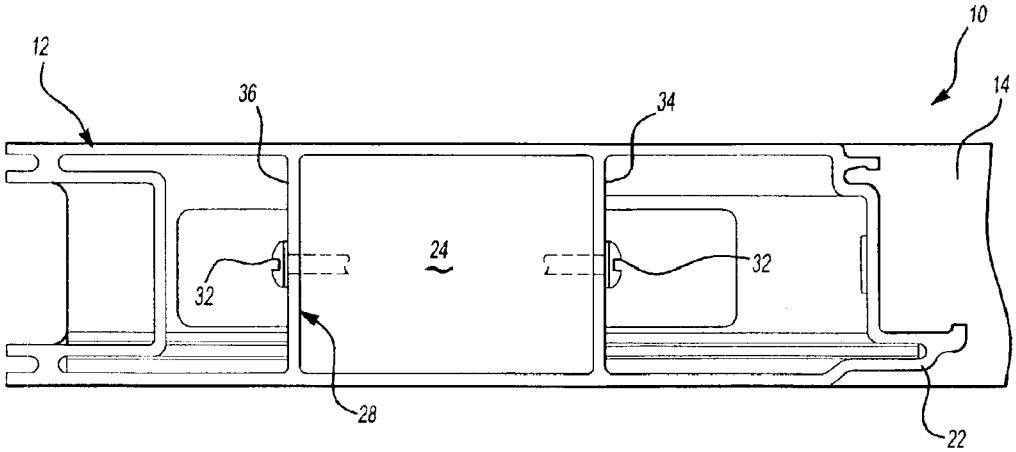
FIG. 3 is a side view taken at cross-section 3—3 of FIG. 1.
Figure 4:
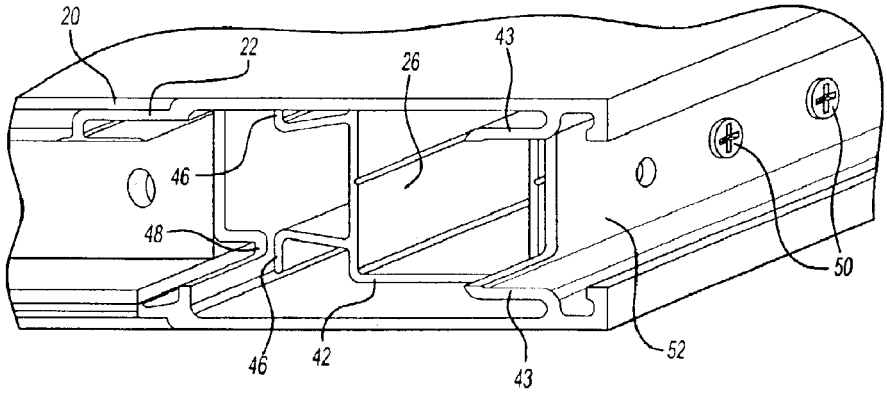
FIG. 4 is a corner view of the assembly as depicted in FIG. 2A.

Referring to FIGS. 1–2B, the rail 12 includes an extension 20 having the first face 16, which overlaps a glazing leg 22 of the stile 14. On an opposing side, an extension 20 overlaps a lip 23 of the stile 14, which receives a retaining member (not shown) to securely retain the glass within the glazing channel, as is known in the art.

The present invention utilizes interlocking complimentary keys having tapered surfaces that form a dovetail-type joint. A male key 24 may be received in a pocket 28 of the rail 12. As best shown in FIG. 2B, the male key 24 includes screw ports 30 receiving fasteners 32 connecting the male member 24 securely to the rail 12. As best shown in FIGS. 2B–4, holes are drilled in the rail where necessary such that the threaded fasteners 32 may be installed and received by the screw ports 30 of the male key 24. The pocket 28 is defined by a wall on one side 34 that receives one pair of threaded fasteners 32, and another wall on another side 36 receiving a second pair of threaded fasteners 32.

Returning now to FIGS. 2A and 2B, the tapered surfaces on the male key 24 are defined by tapered legs 37. An elongated slot 41 is arranged between the tapered legs. The portion of the male key 24 having the tapered legs extends into a pocket 40 in the stile 14. The female key 26 is arranged in the pocket 40 in interlocking relationship with the male key 24. The female key 26 includes tapered walls 44 adjacent to the tapered legs 37 of the male key 24. Flanges 46 extend from the tapered walls 44 and engage at least one ledge 48 defined by the stile 14. Threaded fasteners 50 are secured at a wall 52 in the stile 14 and extend to the male key 24 and into elongated slot 41. The elongated slot 41 is expanded by the threaded fasteners 50 forcing the tapered legs 37 into engagement with the tapered walls 44 to form an interference fit. Furthermore, as the threaded fastener 50 is inserted into the elongated slot 41 the tapered surfaces of the male 24 and female 26 keys cooperate to force the flanges 46 into engagement with the ledge 48 to force the nail 12 and stile 14 into further engagement with one another to ensure the seam 17 is tight. In this manner, the male 24 and female 26 keys are removably secured together.

The keys 24 and 26 are preferably constructed from a sufficient strength aluminum extrusion that may be cut to desired lengths. The thickness of the walls of the keys 24 and 26 are determined by the stresses experienced in the particular closure assembly application. The radii may be enlarged at intersecting walls or legs of the keys 24 and 26 to reduce the stress concentration in that area.

In operation the door is assembled by securing the male key 24 in the pocket 28 of the rail 12 by threaded fasteners 32. The stile 14 is aligned with the rail 12 such that a portion of the male key 24 extends into the pocket 40 of the stile. The female key 26 is inserted into the pocket 40 such that the male 24 and female 26 keys interlock with one another. Threaded fasteners 50 are installed in the stile 14 and extend into the elongated slot 41 of the male key 24 to expand the end of the male key drawing the rail and stile into further engagement.

The invention has been described in an illustrative manner, and it is to be understood that the terminology that has been used is intended to be in the nature of words of description rather than of limitation. Obviously, many modifications and variations of the present invention are possible in light of the above teachings. It is, therefore, to be understood that within the scope of the appended claims the invention may be practiced otherwise than as specifically described.

What is claimed is:

1. A closure assembly comprising:

first and second intersecting members in engagement with one another forming a butt joint;

males and females keys respectively removably secured to said first and second members, said keys having interlocking tapered surfaces; and a fastening element received by at least one of said keys compressing and expanding said tapered surfaces forcing said intersecting members into further engagement with one another at said butt joint, wherein said first and second members respectively include first and second faces forming a contiguous generally planar surface, wherein said first and second members are fiberglass.

2. The closure assembly according to claim 1, wherein said first and second members respectively include first and second wood laminations respectively forming said first and second faces.

3. A closure assembly comprising:

first and second intersecting members in engagement with one another forming a butt joint;

male and female keys respectively removably secured to said first and second members, said keys having interlocking tapered surfaces; and a fastening element received by at least one said keys expanding said tapered surfaces forcing said intersecting members into further engagement with one another at said butt joint, wherein said first and second members respectively include first and second faces forming a contiguous generally planar surface, wherein said first face overlaps a glazing leg extending from an inner side of said second member.

4. A closure assembly comprising:

first and second intersecting members in engagement with one another forming a butt joint;

male and female keys respectively removably secured to said first and second members, said keys having interlocking tapered surfaces; and a fastening element received by at least one of said keys expanding said tapered surfaces forcing said intersecting members into further engagement with one another at said butt joint, wherein said first member includes a first pocket with said male key disposed therein, and threaded fasteners securing said male key to said first member.

5. The closure assembly according to claim 4, wherein said second member includes a second pocket with said female key disposed therein, said male key extending into said second pocket and received by said female key.

6. A closure assembly comprising:

first and second intersecting members in engagement with one another forming a butt joint;

male and female keys respectively secured to said first and second members, said keys having interlocking tapered surfaces;

a fastening element received by at least one of said keys expanding said tapered surfaces forcing said intersecting members into further engagement with one another at said butt joint; and wherein said first member includes a first pocket with said male key disposed therein, and threaded fasteners securing said male key to said first member, wherein said second member includes a second pocket with said female key disposed therein, said male key extending into said second pocket and received by said female key, and wherein said male key includes opposing tapered legs adjacent to corresponding opposing tapered walls of said female key, and an elongated slot between said tapered legs with said fastening clement received in said elongated slot forcing said tapered legs toward said tapered walls.

7. The closure assembly according to claim 6, wherein said fastening element extends through said second member and said female key securing said second member and said female key to one another.

8. The closure assembly according to claim 6, wherein second pocket includes a ledge, and said tapered legs include a flange extending toward said ledge and in engagement therewith.

9. A method of assembling a closure comprising the steps of:

a) securing a first key to a first member;

b) aligning a second member with the first member;

c) inserting a second key into the second member;

d) interlocking the first and second keys; and e) installing a fastening element into at least one of the keys to draw the first and second members into further engagement with one another.

10. The method according to claim 9, wherein step a) includes installing threaded fasteners to secure the first key and the first member to one another.

11. The method according to claim 9, wherein step b) includes placing the first and second member into engagement with one another to form a butt joint.

12. The method according to claim 9, wherein step c) includes sliding the second key into a pocket in the second member with the first key extending into the pocket.

13. The method according to claim 9, wherein the first and second keys are respectively male and female keys and step d) includes receiving the male key with the female key.

14. The method according to claim 13, wherein step e) includes installing a threaded fastener into a slot in the male key expanding the male key creating an interference fit between the male and female keys.

* * * * *